United States Patent [19]

Robinson et al.

[11] 4,409,124

[45] Oct. 11, 1983

[54] PROCESS FOR REGENERATING SULFUR SORBENT BY OXIDATION AND LEACHING

[75] Inventors: Richard C. Robinson, San Rafael; William C. Hecker, Albany, both of Calif.

[73] Assignee: Chevron Research Company, San Francisco, Calif.

[21] Appl. No.: 362,754

[22] Filed: Mar. 29, 1982

[51] Int. Cl.[3] ..... B01J 23/94; B01J 23/92; C10G 29/16; C10G 29/04

[52] U.S. Cl. ..... 502/5; 208/243; 208/246; 502/27; 502/56

[58] Field of Search ..... 252/411 S, 420, 412, 252/413, 416; 208/89, 243

[56] References Cited

U.S. PATENT DOCUMENTS

| | | | |
|---|---|---|---|
| 1,904,218 | 4/1933 | Franceway | 252/412 |
| 2,381,659 | 8/1945 | Frey | 252/411 S |
| 4,008,174 | 2/1977 | Jacobson et al. | 252/411 S |
| 4,204,947 | 5/1980 | Jacobson et al. | 208/89 |
| 4,243,550 | 1/1981 | Burk, Jr. et al. | 252/412 |
| 4,267,032 | 5/1981 | Burk, Jr. et al. | 252/420 |

*Primary Examiner*—P. E. Konopka

*Attorney, Agent, or Firm*—Burns, Doane, Swecker & Mathis

[57] ABSTRACT

A process for regenerating a spent copper-porous refractory metal oxide carrier composite for sorbing sulfur compounds from hydrocarbons in which the spent sorbent is stripped of hydrocarbons, oxidized to convert absorbed sulfur to a sulfate form, and then extracted with a liquid solvent to remove the sulfate and reduce the sulfur content of the sorbent.

7 Claims, No Drawings

PROCESS FOR REGENERATING SULFUR SORBENT BY OXIDATION AND LEACHING

BACKGROUND OF THE INVENTION

1. Field of the Invention

The invention relates to a process for regenerating a spent copper-based sorbent or scavenger for removing sulfur-containing compounds from hydrocarbons.

2. Description of the Art

U.S. Pat. No. 4,163,708 describes the use of composites of copper compounds and inorganic porous carriers for removing thiol impurities from hydrocarbons to prepare the hydrocarbons for catalytic reforming using platinum or platinum-containing bimetallic catalysts that are poisoned by thiol compounds. The patent teaches that spent composites may be regenerated in a three-stage regeneration process. In the first stage adhered hydrocarbons are stripped from the spent sorbent (scavenger) with a stripping gas. After the stripping, the sorbent is subjected to oxidizing conditions to oxidize residual carbon, hydrocarbon, and sulfur compounds on the sorbent. Gas containing a small volume percent of molecular oxygen at 190° C. to 260° C. is a suggested oxidizing medium. The third and final stage of regeneration is to subject the sorbent to a reducing atmosphere to convert copper-sulfur-oxygen moieties on the scavenger to copper oxide/copper metal and sulfur dioxide. The sulfur dioxide is carried away by the reducing gas leaving only copper oxide/copper metal on the porous carrier. Nitrogen gas containing a few volume percent hydrogen at 188° C., 5.4 to 6.4 atm is suggested as a reducing medium.

Copending commonly owned U.S. application Ser. No. 367,070 describes a process for regenerating the sulfur sorbent of U.S. Pat. No. 4,163,708 in which after stripping, oxidation, and reduction, the sorbent is impregnated with a copper salt and then calcined to convert the impregnated salt to copper metal/copper oxide. This regeneration process is said to be especially useful for regenerating sorbents that do not contain an inherent catalytic oxidizing catalyst and have been used to remove primarily mercaptans from hydrocarbon feedstocks. The oxidation step in this regeneration is carried out at 400° C. to 650° C. The reduction step is optional and employs a reducing gas, typically nitrogen containing a few percent hydrogen at 500° C. to 700° C.

Yet another process for regenerating the sulfur sorbent of U.S. Pat. No. 4,163,708 is disclosed in commonly owned U.S. application Ser. No. 362,755. Its regeneration is basically a two step process in which stripped spent sorbent is oxidized to convert sulfur to a sulfate form and then purged with an inert gas at an elevated temperature which converts the sulfate to sulfur dioxide that is carried off by the inert gas. The oxidation step in this process is normally carried out at about 450° C. to 650° C. The inert purge step is normally carried out at 550° C. to 700° C.

A principal object of the present invention is to provide an alternative regeneration process to those described above.

SUMMARY OF THE INVENTION

The invention is a process for regenerating a spent copper-inorganic porous carrier composite sorbent for removing thiol compounds from hydrocarbons comprising:

(a) contacting the spent sorbent with an oxidizing gas at a temperature and for a time sufficient to convert the sulfur in the sorbent to a sulfate form; and (b) contacting the oxidized sorbent with a liquid solvent, preferably an aqueous solution, for said sulfate form whereby a substantial portion of said sulfate form is extracted from the oxidized sorbent by the liquid solvent.

Sorbed hydrocarbons are optionally stripped from the spent sorbent before it is oxidized.

DETAILED DESCRIPTION OF THE INVENTION

The sorbents that are regenerated by the invention process are used to remove sulfur-containing compounds such as hydrogen sulfide and mercaptans from hydrocarbons that boil in the range of about 50° C. to 200° C. at 760 mm Hg. These hydrocarbons are typically derived from petroleum, oil shale, coal, tar, or other sources and include such refining streams as straightrun and refined naphthas, hydrocrackates and fractions thereof, diesel oil, jet fuel, fuel oil, and kerosene. Preferably, the hydrocarbon is a feedstock to a catalytic reforming process that employs a platinum or platinum-containing bimetallic reforming catalyst. These hydrocarbons will normally contain about 1 to about 10 wppm sulfur before being treated with the sorbent.

The sorbent comprises in its fresh form copper metal and/or copper oxide on an inorganic porous refractory carrier. The copper component will usually constitute about 5% to 50% by weight, preferably 20% to 40% by weight, of the sorbent, calculated as copper metal. The carrier will typically be a natural or synthetic refractory oxide of a Group II, III, or IV metal or mixtures thereof. Examples of such carriers are alumina, silica, silica-alumina, boria, kieselguhr, attapulgite clay, and pumice. The carrier or the sorbent per se will usually have a specific surface area (measured by the B.E.T. method) in the range of about 50 to 250 $m^2/g$, preferably 100 to 200 $m^2/g$. The sorbent particles will usually be pellet shaped and have an average diameter between about 0.1 to about 0.5 cm and an L/D ratio (length to diameter) in the range of 1:1 to 10:1.

The sorbent may be made by impregnating the carrier with an aqueous solution of a water soluble copper salt, the anionic portion of which may be readily removed from the composite after or upon drying. An alternative and preferred method for making the sorbent is by comulling particulate carrier and insoluble particulate copper carbonate in a concentrated aqueous slurry, extruding the mixture into pellets, and calcining the pellets to drive carbon dioxide off the copper carbonate. This comulling method is described in U.S. Pat. No. 4,259,213.

Sulfur-containing compounds, typically present at 0.5 to 30 wppm, are removed from the hydrocarbon by contacting the hydrocarbon with the sorbent at temperatures in the range of about 60° C. to about 250° C., preferably 80° C. to 150° C., and pressures that maintain the hydrocarbon in the liquid phase. Such contacting may be carried out by passing the hydrocarbon through one or more fixed bed downflow or upflow sorbing vessels charged with the sorbent. The liquid hourly space velocity (LHSV) will typically be in the range of 3 to 15. Such contacting will usually remove sulfur-containing compounds from the hydrocarbon to the extent that the sulfur content of the effluent from the sorbent bed(s) is less than about 0.5 wppm, preferably less than 0.2 wppm. Once the sorbent is saturated with sulfur compounds, the sorbent is spent and must be regenerated. This end point may be determined by monitoring the sulfur content of the effluent, with the end point being indicated by a rise in sulfur content above about 20% by weight of the sulfur content of the feed. In most instances the end point will be indicated by an effluent content above about 1 to 2 wppm.

The spent sorbent is regenerated according to the invention process as follows. If the spent sorbent contains substantial amounts of residual hydrocarbons, it is desirable to strip the hydrocarbons from the sorbent before the sorbent is subjected to the oxidizing gas. Stripping gases such as nitrogen, hydrogen, steam, carbon dioxide, or mixtures thereof may be used. The stripping may be carried out at the temperatures used in the sulfur removal (80° C.–150° C.) and may be facilitated by lowering the system pressure from the pressures used in the sulfur removal. Stripping is complete when the stripping gas effluent is substantially free of hydrocarbons.

The next step in the regeneration is contacting the hydrocarbon-stripped sorbent with an oxidizing gas at an elevated temperature, usually in the range of 350° C. to 700° C., and more usually in the range of 450° C. to 650° C. Residual carbon and any residual hydrocarbons on the sorbent are oxidized in this step to carbon dioxide and water whereas the sulfur (in the form of absorbed thiols and/or copper sulfide) is oxidized to a sulfate form. The sulfate form is believed to be primarily a copper oxide sulfate complex (dolerophanite). The contact time should be sufficient to convert substantially all the sulfur to sulfate. Use of longer contact times are not detrimental and will merely convert a portion of the sulfate to sulfur dioxide which is liberated into the oxidizing gas. The oxidizing gas may be air or mixtures of nitrogen or other inert gases and oxygen that contain more or less oxygen than air. The GHSV used in the oxidation step will depend upon the oxygen content of the oxidizing gas and the duration of the step. For 2% oxygen in nitrogen the GHSV will usually range between about 200 to 2,000 volumes of gas per volume of catalyst per hour. The time for oxidation is usually between about 12 and 48 hours. Such conditions will be sufficient to combust all the carbon deposits and to oxidize the copper sulfide to dolerophanite ($CuO.CuSO_4$) or other sulfate complexes.

After the oxidation, the sorbent is contacted with a liquid that is a solvent for the sulfate residue (aluminum sulfate or copper sulfate complexes) on the sorbent. Such liquids include water, methanol, ethanol, weak inorganic or organic acids such as $H_2SO_4$, HCl, acetic acid, and formic acid and bases such as $NH_4OH$, NaOH, KOH, and phenol or other solutions of inorganic or organic salts, such as $NH_4Cl$, NaCl, $Na_2SO_4$, Na acetate, and $NH_4SO_4$ in water. Aqueous-based solvents that leave no residue or only an innocuous residue on the sorbent after solvent removal are preferred. The temperature at which the contacting is carried out is not critical and will usually be in the range of 20° C. to 100° C. Since the solubility of the sulfate in the liquid generally increases with increasing temperature, the higher temperatures in the above range (i.e. 50° C. to 80° C.) are preferred. The contacting may be done on a batch or continuous flow basis. A continuous flow extraction in which the solvent is passed through a bed of the sorbent is preferred. The extraction may be monitored by either the amount of sulfur remaining on the sorbent or the amount of sulfate in the leachate. In this regard, the amount of sulfur remaining on the sorbent after the extraction will normally be less than about three % by wt and preferably less than about two % by wt.

The sorbent particles may be contacted with the solvent in the form in which they emerge from the oxidation or they may be crushed to a more finely divided form to facilitate extraction of the sulfate. If the sorbent is crushed, it will usually have to be reconstituted into pellet form before being reused. After the extraction is complete, excess extractant is removed from the sorbent by filtration, centrifugation or other conventional solids-liquid separation techniques and the sorbent is dried to evaporate any remaining traces of solvent from it.

The stripping of hydrocarbons from the sorbent will typically be carried out in the sorbing vessels which will, of course, be equipped with lines, valves, and other mechanisms required to pass the stripping gas through the vessels and regulate the temperatures and pressures in the vessels to those ranges required for the step. The oxidation and extraction steps will usually require removal of the sorbent from the sorbing vessels and placement in other vessels or containers which are designed for these purposes. The oxidation and extraction steps may be carried out by placing the stripped sorbent into fixed bed downflow or upflow vessels and passing the oxidizing gas/extractant sequentially through the sorbent bed at the desired temperatures and flow rates until the oxidation/extraction is complete.

The following examples further illustrate the invention process. These examples are not intended to limit the invention in any manner.

EXAMPLE 1

A spent sulfur sorbent was regenerated as follows. The original (prior to use) composition of the sorbent was CuO 28% by weight calculated as metal Alumina 65% by weight.

This sorbent was made by the basic process described in U.S. Pat. No. 4,259,213 and was used to remove sulfur compounds from petroleum naphtha feedstocks. In its spent condition it contained approximately 6.7% by weight sulfur as copper sulfide.

A sample of this spent sorbent was placed in a laboratory furnace and it was oxidized with air at about 600° C. for two hours, followed by stripping with nitrogen. Analysis of the oxidized sorbent indicated it contained 6% by weight sulfur. The oxidized sorbent was then placed in a vessel and extracted with water at room temperature overnight. The sorbent was then removed from the vessel, dried at about 120° C. for ~4 hr to evaporate off residual water, and calcined at about 500° C. for 2 hr. Analysis of the regenerated sorbent after extraction, drying, and calcining showed it contained 3.5% by weight sulfur and 26.7% copper by weight.

The extent of regeneration of the sorbent was determined by using it to remove mercaptan sulfur from a Midcontinent petroleum naphtha. The sorbent was placed in a laboratory sorbing vessel as the naphtha, containing 20 wppm sulfur, was passed through the vessel at about 185° C., 150 psig and a LHSV of 6. The time to breakthrough (the run time at which the sulfur in the vessel effluent was 20% of the sulfur in the feed, i.e. 4 wppm) was 360 hr. This time to breakthrough was compared to the time to breakthrough of a comparable run using fresh sorbent to determine the regenerated sorbent's lifetime based on breakthrough time was 73% of the lifetime of the fresh sorbent.

EXAMPLE 2

A spent sulfur sorbent was regenerated as follows. The original (prior to use) composition of the sorbent was CuO 27% by weight calculated as metal Alumina 66.5% by weight.

This sorbent was made by the basic process described in U.S. Pat. No. 4,259,213 and was used to remove sulfur compounds from petroleum naphtha feedstocks. In its spent condition it contained approximately 4.6% by weight sulfur.

A sample of this spent sorbent was placed in a laboratory reactor and it was oxidized with 1.0% $O_2$ in $N_2$ at about 500° C. for 48 hours, followed by cooling with nitrogen. Analysis of the oxidized sorbent indicated it contained 4.5% by weight sulfur. The oxidized sorbent was then placed in a vessel and extracted with water at room temperature overnight. The sorbent was then removed from the vessel, dried at about 120° C. for 2 hrs to evaporate off residual water, and calcined at about 350° C. for 2 hr. Analysis of the regenerated sorbent after extraction, drying, and calcining showed it contained 2.4% by weight sulfur and 24.5% copper by weight.

The extent of regeneration of the sorbent was determined by using it to remove mercaptan sulfur from a Midcontinent petroleum naphtha. The sorbent was placed in a laboratory sorbing vessel as the naphtha, containing 22 wppm sulfur, was passed through the vessel at about 185° C., 150 psig and a LHSV of 5. The time to breakthrough (the run time at which the sulfur in the vessel effluent was 20% of the sulfur in the feed, i.e. 4.5 wppm) was 420 hr. This time to breakthrough was compared to the time to breakthrough of a comparable run using fresh sorbent to determine the regenerated sorbent's lifetime based on breakthrough time was 80% of the lifetime of the fresh sorbent.

EXAMPLE 3

Another spent sulfur sorbent was regenerated as follows. The original (prior to use) composition of the sorbent was CuO 18% by weight calculated metal Alumina 77.5% by weight.

This sorbent was also made by the basic process described in U.S. Pat. No. 4,259,213 and was used to remove sulfur compounds from petroleum naphtha feedstocks. In its spent condition, it contained 5.0% by weight sulfur.

A sample of this spent sorbent was oxidized with air for 5 hr at approximately 500° C. using a commercial moving belt. Analysis of the oxidized sorbent indicated it contained 4.9% by weight sulfur. The oxidized sorbent was then placed in a vessel and extracted with hot water overnight. The sorbent was then dried at about 350° C. for 2 hr. Analysis of the thus regenerated sorbent indicated it contained 1.13% by weight sulfur and 16% copper by weight.

Modifications of the above described modes for carrying out the invention process that are obvious to those of ordinary skill in the chemical, sorption, and/or refining arts are intended to be within the scope of the following claims.

We claim:

1. A process for regenerating a spent copper-inorganic porous carrier composite sorbent for removing thiol compounds from hydrocarbons in which the copper component of the sorbent constitutes about 5% to 50% by weight of copper calculated as copper metal comprising:

(a) contacting the spent sorbent with an oxidizing gas at a temperature of 350° C. to 700° C. for a time sufficient to convert the sulfur in the sorbent to a sulfate form; and (b) directly after step (a) contacting the oxidized sorbent with a liquid solvent for said sulfate form whereby a substantial portion of said sulfate form is extracted from the oxidized sorbent by the solvent.

2. The process of claim 1 wherein sorbed hydrocarbons are stripped from the spent sorbent before step (a).

3. The process of claim 1 or 2 wherein the contacting of the oxidized sorbent with said solvent reduces the sulfur content of the sorbent to below about three % by weight.

4. The process of claim 1 wherein the contacting of the oxidized sorbent with said solvent reduces the sulfur content of the sorbent to below about two % by weight.

5. The process of claim 1, 2 or 4 wherein the extraction is carried out at a temperature in the range of 20° C. to 100° C.

6. The process of claim 3 wherein the liquid solvent is an aqueous based solvent.

7. The process of claim 3 wherein the liquid solvent is water.

* * * * *